US006148922A

United States Patent [19]

Vatne

[11] Patent Number: 6,148,922

[45] Date of Patent: Nov. 21, 2000

[54] SLIP JOINT

[75] Inventor: Per Vatne, Rabbersvik, Norway

[73] Assignee: Maritime Hydraulics AS, Kristiansand, Norway

[21] Appl. No.: 09/180,607

[22] PCT Filed: May 5, 1997

[86] PCT No.: PCT/NO97/00115

§ 371 Date: Nov. 12, 1998

§ 102(e) Date: Nov. 12, 1998

[87] PCT Pub. No.: WO97/43516

PCT Pub. Date: Nov. 20, 1997

[30] Foreign Application Priority Data

May 13, 1996 [NO] Norway ..... 961945

[51] Int. Cl.[7] ..... E21B 17/07; E21B 17/08; E21B 33/043

[52] U.S. Cl. ..... 166/367; 166/355; 405/224.2

[58] Field of Search ..... 166/355, 367; 405/224.2

[56] References Cited

U.S. PATENT DOCUMENTS

| | | | |
|---|---|---|---|
| 3,353,851 | 11/1967 | Vincent | 166/355 |
| 3,354,950 | 11/1967 | Hyde | 166/355 X |
| 3,465,817 | 9/1969 | Vincent | 166/355 |
| 3,601,187 | 8/1971 | Tidwell | 166/355 X |
| 3,952,526 | 4/1976 | Watkins et al. | 405/224.2 |
| 3,955,621 | 5/1976 | Webb | 166/355 |
| 3,983,706 | 10/1976 | Kalinowski | 166/355 X |
| 4,367,981 | 1/1983 | Shapiro | 166/355 X |
| 4,615,542 | 10/1986 | Ideno et al. | 166/355 X |
| 4,693,316 | 9/1987 | Ringgenberg et al. | 166/355 |
| 4,733,991 | 3/1988 | Myers | 166/367 X |
| 4,883,387 | 11/1989 | Myers et al. | 166/367 X |
| 5,660,233 | 8/1997 | Sparks | 166/367 |
| 5,823,264 | 10/1998 | Ringgenberg | 166/355 |

FOREIGN PATENT DOCUMENTS

| | | |
|---|---|---|
| 122006 | 5/1971 | Norway . |
| 90/05236 | 5/1990 | WIPO . |

*Primary Examiner*—Eileen D. Lillis
*Assistant Examiner*—Tara L. Mayo
*Attorney, Agent, or Firm*—Pillsbury Madison & Sutro LLP

[57] ABSTRACT

A slide joint for a riser between a well and a floating petroleum installation such as an oil platform includes an outer pipe and an inner pipe which are adapted to move telescopically relative to one another to compensate for changes in the distance between the sea bed and the platform. The inner pipe is connected to a piston, which piston is responsive to actuation by hydraulic pressure in order to provide tractive force on the riser. The outer diameter of the inner pipe is adapted to the diameter of the outer pipe so as to form an annulus between the pipes. The piston is fixedly connected to the inner pipe at or near the downward oriented end thereof, said annulus above the piston being subjected to hydraulic pressure. Below the piston is provided a protective sleeve, which is slidably disposed within the outer pipe.

8 Claims, 4 Drawing Sheets

11
24
23
17
26
25
12

15
11
27
32
12
28
30

29
30
31

12
19
21
20
19
12
21
29
34
20
33

34
33

29
12
36
35

22

SLIP JOINT

BACKGROUND OF THE INVENTION

1. Field of the Invention

The present invention relates to a slide joint for a riser between a well and a floating petroleum installation, for example, an oil platform, comprising an outer pipe and an inner pipe, which pipes are adapted to move telescopically relative to one another to compensate for changes in the distance between the sea bed and the platform.

2. Description of the Background Information

A known slide joint of this type is shown in FIG. 1. To maintain tension in the riser, a plurality of wires are attached to the upper end of the outer pipe, which wires in turn are connected to a plurality of tensioners, which exert a constant tension on the riser. The wires, tensioners, appurtenant collection reels and other equipment associated with the tensioning apparatus for the riser require considerable space and, in addition, are very heavy. Moreover, the wires are under substantial strain and must be inspected and changed relatively often.

SUMMARY OF THE INVENTION

An object of the present invention is to replace the wires, tensioners and collection reels, as well as the other equipment connected thereto, with far simple and lighter equipment requiring less space. It is also an objective to provide a slide joint having improved functional efficiency and greater reliability.

This is achieved by connecting the inner pipe to a piston, which piston is responsive to actuation by hydraulic fluid to provide tractive force on the riser.

This apparatus enables savings in equipment weight in the magnitude of 100 tons, which is a considerable weight even on a large oil platform. The equipment is, moreover, far less demanding in terms of space and provides increased functional efficiency in that the riser is able to swing freely in the vertical plane without obstruction by taut wires. The tractive force exerted on the riser is entirely axial, thus avoiding the incidence of adverse lateral forces on the riser. Maintenance is also simplified considerably, for the only components that must be replaced frequently are the hydraulic hoses. There is a double set of hydraulic hoses, permitting the changing of these hoses one by one without having to shut down the system.

BRIEF DESCRIPTION OF THE DRAWINGS

The invention shall now be described in more detail with reference to the accompanying drawings, wherein.

DETAILED DESCRIPTION OF THE EMBODIMENTS

Figure 1:
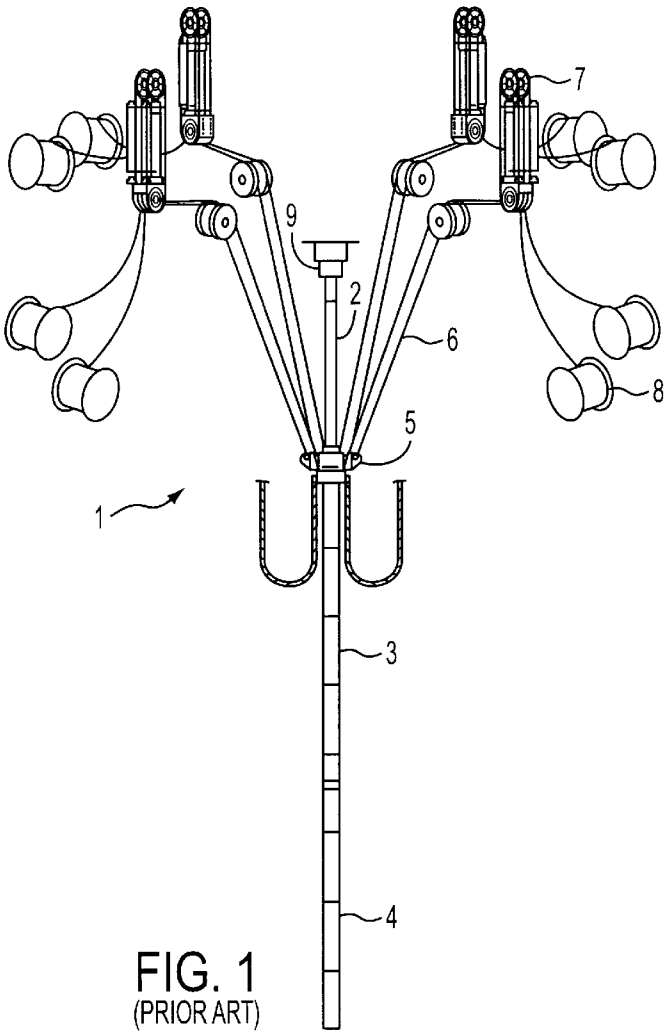
FIG. 1 (PRIOR ART)
FIG. 1 shows a slide joint according to the known technique.

FIG. 1 shows a slide joint 1 in accordance with the prior art. Slide joint 1 consists of an inner pipe 2 and an outer pipe 3. Outer pipe 3 is connected to the rest of the riser 4, which extends down into the well (not shown). Outer pipe 3 is provided at the upper end thereof with a collar 5 to which is connected a plurality of wires 6, which in turn are connected to tensioners 7. There are also provided collection reels 8 for wire. The inner pipe is connected via a flexible coupling 9 to the production equipment on the platform (not shown). In FIG. 1 there are also shown two hoses, which are connected via ducts in riser 4 with the blow out of preventer (BOP), one of these hoses being adapted to throttle the return from the well, while the other hose is adapted for pumping kill mud down into the well.

Figure 2:
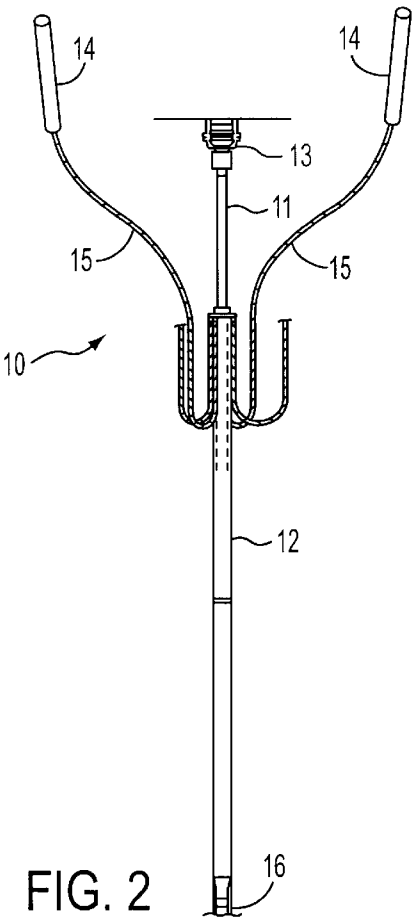
FIG. 2 shows a slide joint according to the invention.

In FIG. 2 a slide joint 10 in accordance with the invention is shown. The slide joint here also consists of an inner pipe 11 and an outer pipe 12. Inner pipe 11 is here also connected to the platform's production equipment via a flexible coupling 13. Here, however, the slide joint is attached to hydraulic accumulators 14 which, via hydraulic hoses 15, supply hydraulic pressure to slide joint 10, causing riser 16 to be placed under tension.

Figure 3:
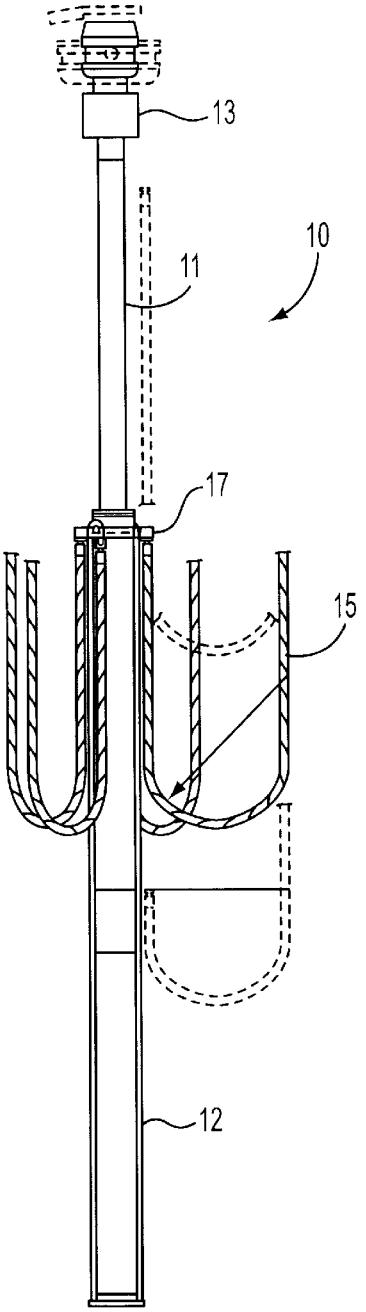
FIG. 3 shows the slide joint in more detail.
Figure 4:
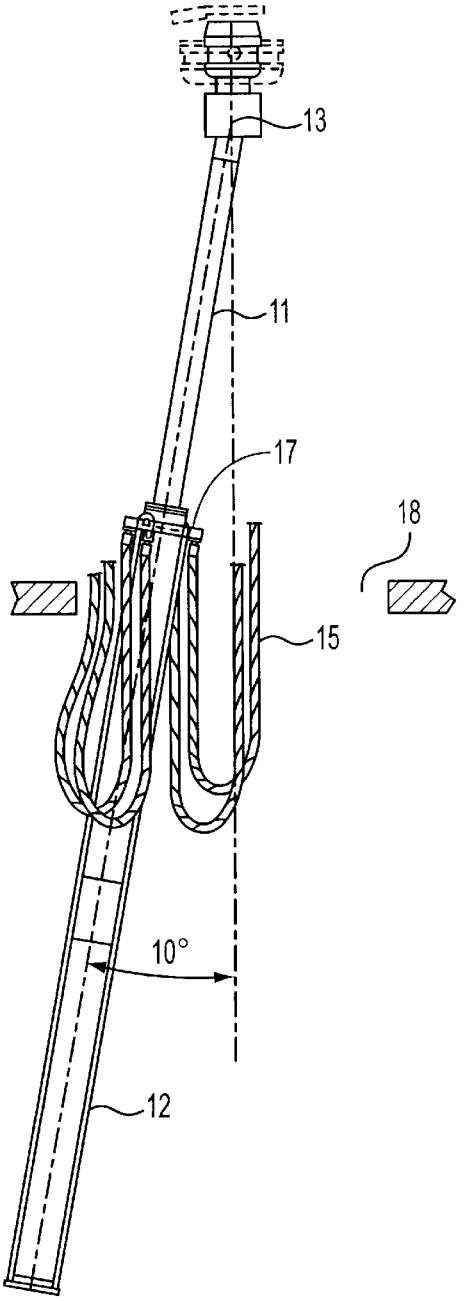
FIG. 4 shows the riser with the slide joint in even greater detail.

FIG. 3 shows the slide joint in more detail. Here we also see inner pipe 11, outer pipe 12 and flexible coupling 13. Hydraulic hoses 15 are attached to a manifold ring 17, which is connected to the upper end of outer pipe 12. In FIG. 4 the riser and slide joint 10 are shown in a position that is swung out 10° to the side. This outward swing is permitted without the hindrance of wires or other equipment. The slide joint is therefore capable of swinging outward until it is in quite close proximity to the edge of the moon pool 18.

Figures 5, 5A, 5B, 5C, 5D, 5E, 5F:
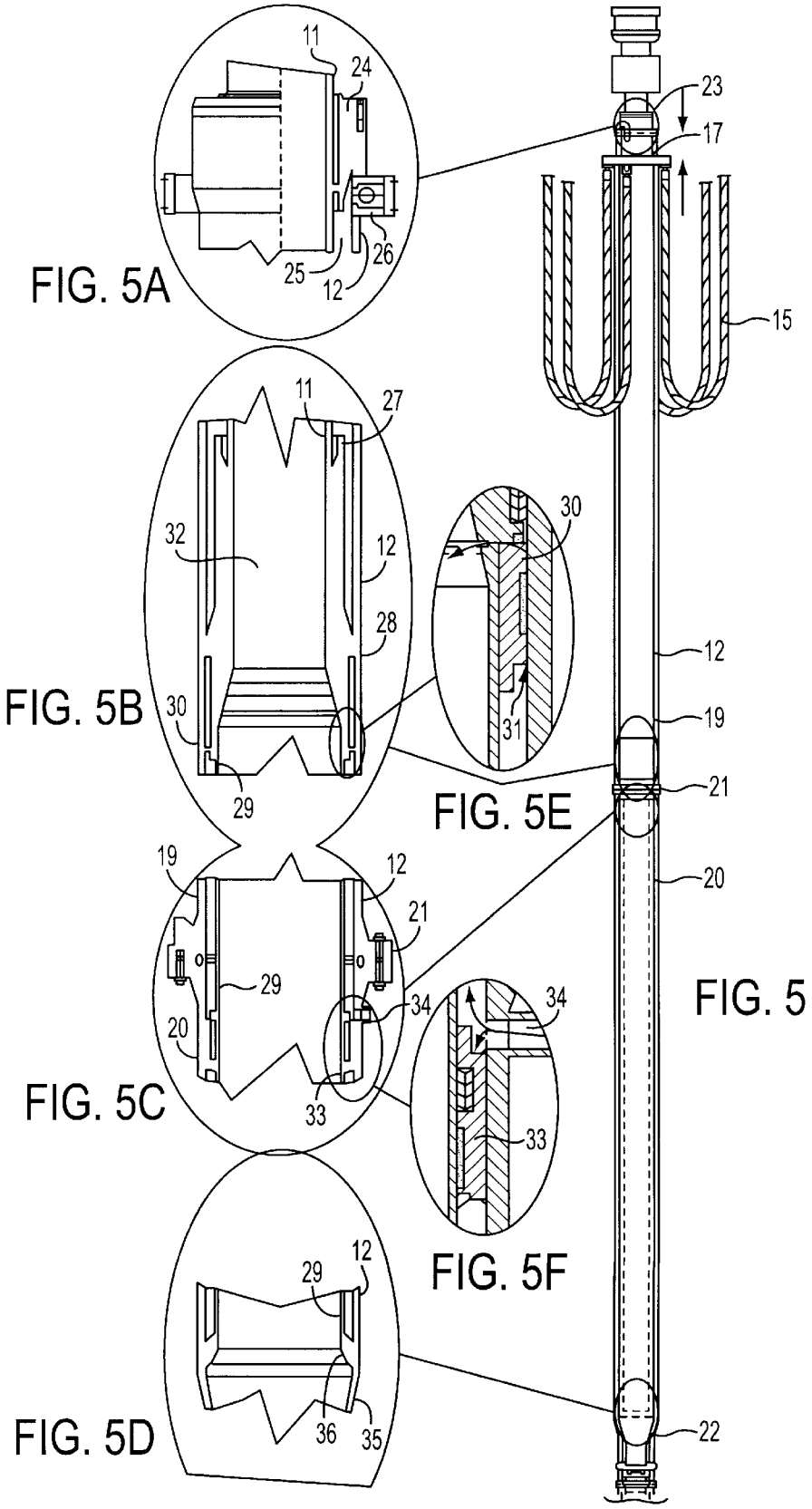
FIGS. 5*a*–5*f* show sections of various parts of the slide joint and the riser.

In FIG. 5 the slide joint is shown in even more detail. Outer pipe 12 consists of two parts, an upper part 19 and a lower part 20, which are joined together by a flange connection 21. The outer lower pipe 20 has an internal bore which is narrowed at its lower end 22.

FIGS. 5*a*–5*f* shall now be described. FIG. 5*a* is a cross-section of the upper end 23 of the outer pipe, and shows a section of inner pipe 11 and outer pipe 12. At the upper end 23 of outer pipe 12 is mounted a packer 24 which forms a seal between the internal surface of outer pipe 12 and the external surface of inner pipe 11. Beneath packer 24 the manifold ring 17 is in hydraulic communication with annulus 25 between inner pipe 11 and outer pipe 12 via an automatic shutoff valve 26.

FIG. 5*b* shows a section of the slide joint at the lower end of inner pipe 11. Here we see a piston 27, which is connected to inner pipe 11. Piston 27 is sealed against the internal surface of the outer pipe by means of a packer 28. Annulus 25 is thus isolated, except for the hydraulic communication with hoses 15. In FIG. 5*b* is also shown the upper end of a protective sleeve 29, which is provided with a combined packer and piston 30 which forms a seal against the internal surface of outer pipe 12. In FIG. 5*e* this packer is shown in more detail. Packer 30 does not form a complete seal against the internal surface of outer pipe 12, but permits a slight leakage from annulus 31, which is formed between protective sleeve 29 and outer pipe 12, and in addition a slight leakage between protective sleeve 29 and piston 27 to boring 32, for the transport of mud and petroleum products. The reason for this slight leakage will be explained later. FIG. 5*c* shows a section of outer pipe 12 at its flange connection 21 between the upper part 19 and the lower part 20, and also shows a section of protective sleeve 29 a slight distance below the upper end thereof. Outer pipe 12 is here provided with a packer 33, which is shown in more detail in FIG. 5*f*. Packer 33 forms a seal against protective sleeve 29. Directly above packer 33 is provided a passage 34 for supply of pressure medium, for example air or water, to permit the pressurizing of annulus 31. This will also be explained later. FIG. 5*d* shows a section near the lower end of outer pipe 12 and a section from the lower end of the protective sleeve. Here we see that outer pipe 12 becomes narrower at 35. Protective sleeve 29 is provided at the lower end thereof with a guide and scrape ring 36, which has an external diameter that is larger than the smallest diameter of outer pipe 12 at 35.

When hydraulic pressure is supplied via hoses 15 to annulus 25 between inner pipe 11 and outer pipe 12, the inner pipe and the outer pipe will telescopically slide together. Riser 16 is thereby placed under tension. The tension may be regulated by increasing or lowering the hydraulic pressure. For work at greater sea depths, with a riser that is altogether relatively heavy, a much higher pressure will be required than with a riser employed at lesser sea depths.

To avoid the possibility that mud, petroleum products or tools, such as drill heads or the like, will scrape up or otherwise damage the internal surface of outer pipe 12, such that piston 28 is no longer able to slide without difficulty along the internal surface of outer pipe 12, the protective sleeve 29 is provided in order to protect the internal surface of outer pipe 12. With the aid of fluid supply through passage 34, protective sleeve 29 is held at all times in contact against piston 28. The pressure supplied to annulus 31 through passage 34 is preferably constant. The permitting of a slight leakage past packer 30 ensures that mud or petroleum products will not be able to penetrate into annulus 31. Protective sleeve 29 is so long that its lower end provided with scrape ring 36 will never move above the lowermost position for piston 28.

Figure 6:
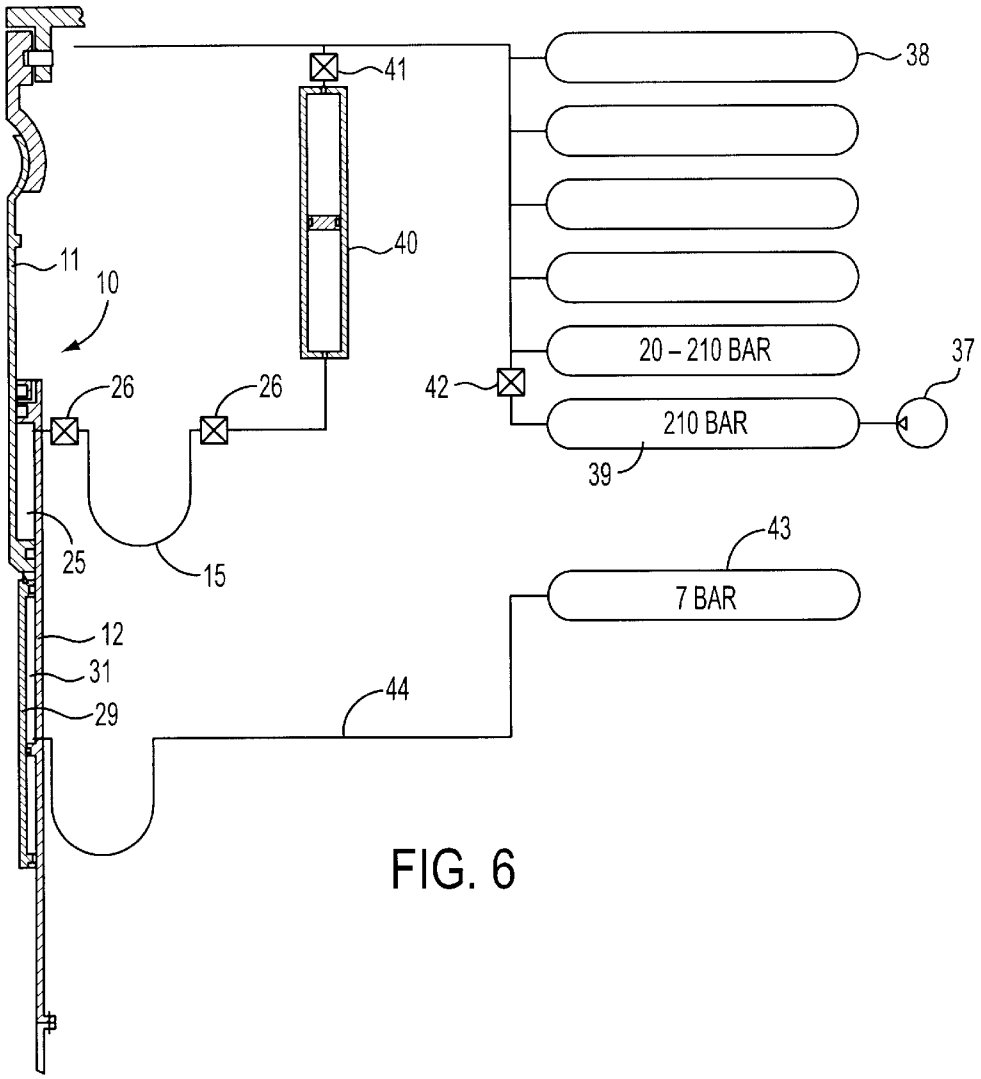
FIG. 6 is a schematic view of the inventions hydraulic system.

FIG. 6 shows the hydraulic system. Here we also see slide joint 10 with inner pipe 11 and outer pipe 12. Protective sleeve 29 is also shown. A pump 37 delivers air to a plurality of air tanks 38. One of the air tanks functions as a stand-by pressure tank 39 and at all times places at disposal a pressure of 210 bar for those instances when inner pipe 11 must be moved rapidly relative to outer pipe 12. The tanks 38, 39 are connected to accumulators 40 via a valve 41. A valve 42 is also installed between tank 39 and the other tanks 38. Accumulators 40 are connected with annulus 25 via hydraulic hoses 15 equipped with an automatic shutoff valve 26 at each end.

Further, there is provided a pressure tank 43 which, via a hose 44, places annulus 31 under a moderate pressure in order to maintain the contact of protective sleeve 29 against inner pipe 11.

During normal operation the pressure in tanks 38 may vary between 20 and 210 bar, according to the particular speed at which slide joint 10 must move and to the magnitude of the forces that occur. When necessary, however, a pressure of 210 bar in tank 39 is available.

Figure 6A:
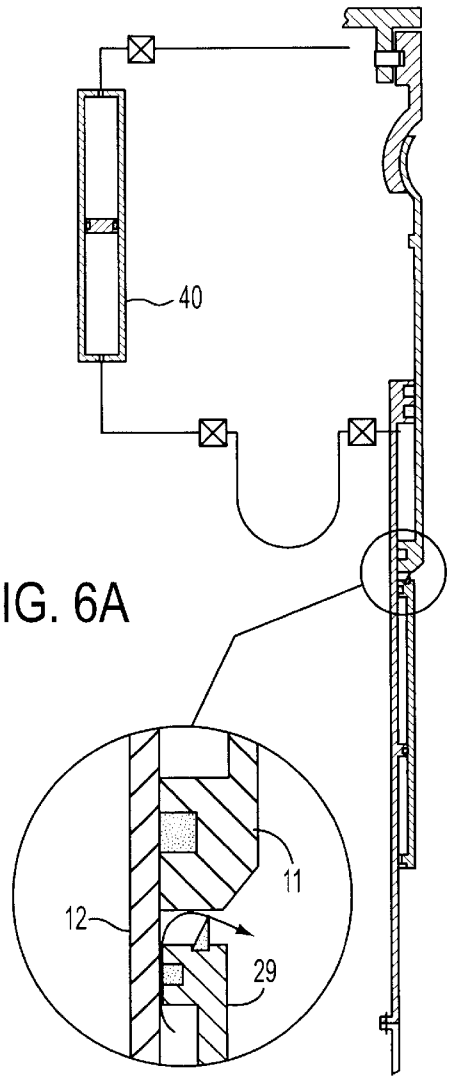
FIG. 6*a* is a detail of a portion of the hydraulic system.

The section in FIG. 6*a* illustrates a somewhat different embodiment of the connection between protective sleeve 29 and inner pipe 11.

Protective sleeve 29 could have been fixed permanently to inner pipe 11, but this would make more difficult the handling of the slide joint during both transport and installation. Since outer pipe 12 is divided into two parts, 12 and 20, the outer pipe may be divided at flange coupling 21. When this is done, one must ensure that protective sleeve 29 is situated within the lower part 20, at the same time as inner pipe 11 must be situated within the upper part 19. The slide joint may thus be transported in two parts and may be installed by first putting lower part 20 together with riser 16, whereupon the riser is lowered until the flange coupling 21 is situated at a convenient level. Now the upper part 19 may be put together with lower part 20.

In order to keep the internal pipe protected as well as possible during handling, a lowering procedure has been established for the BOP to be installed together with the slide joint, this being that the BOP is held in retracted position and is locked hydraulically. This procedure also makes it possible to connect the hydraulic hoses, as well as the throttle and shutoff hoses, at a convenient level prior to installation of the BOP. All the hoses are collected on the main manifold ring 17. Manifold ring 17 is locked in position when the slide joint is slid through the rotary bore. A special handling tool is used to install the BOP and to suspend the slide joint. When the BOP is locked on the sea bed, the tractive force on the slide joint is activated, and the inner pipe 11 is drawn out and the suspension head is mounted the suspension socket and locked securely there.

I claim:

1. A slide joint for a riser between a well and a petroleum installation having a platform, comprising:

an outer pipe having an upper section and a lower section;

an inner pipe, accommodated in the upper section of the outer pipe, the outer and inner pipes adapted to move telescopically relative to one another to compensate for changes in relative positions of the well and the platform;

a first piston, the first piston being connected to a downward oriented end of the inner pipe, the first piston being responsive to actuation by hydraulic pressure to provide a tractive force on the riser;

wherein a first annulus is formed between the inner pipe and the outer pipe, the first annulus being isolated from both a well fluid and a surrounding fluid, said first annulus above the first piston being subjected to hydraulic pressure;

a protective sleeve, slidably disposed within lower section of the outer pipe below the first piston, the protective sleeve being pressure actuated to make contact with a lower end of the inner pipe, the protective sleeve being provided with an upper piston;

wherein a second annulus is formed between the protective sleeve and the outer pipe, and the second annulus is subjected to a pressure when the protective sleeve is in contact with the lower end of the inner pipe, the pressure on the second annulus sealing the first piston against contact with the well fluid, the annular area of the upper piston toward the second annulus is greater than the annular area of the upper piston towards a third annulus on the opposite side of the upper piston, such that any leakage of fluid past the upper piston occurs in a direction from the second annulus to the third annulus on the opposite side of the upper piston.

2. The slide joint according to claim 1, wherein:

the protective sleeve is provided with an upper packer at the upper end thereof which seals against the outer pipe and a packer which seals against at least one of the first piston and the inner pipe, and the outer pipe at a point below the packer is provided with a lower packer which seals against the protective sleeve.

3. The slide joint according to claim 2, wherein the upper packer and the packer between the protective sleeve and the inner pipe are designed to permit small amounts of fluid to pass from the annulus between the protective sleeve and the outer pipe.

4. The slide joint according to claim 3, further comprising:

a double set of hydraulic conduits in hydraulic communication with the upper side of the first piston; and a shutoff valve at each end of each of the hydraulic conduits which serves to close off the hydraulic communication if a leakage should occur in the conduit, thus enabling the slide joint to function satisfactorily with only one conduit intact.

5. The slide joint according to claim 2, further comprising:

a double set of hydraulic conduits in hydraulic communication with the upper side of the first piston, and a shutoff valve at each end of each of the hydraulic conduits which serves to close off the hydraulic communication if a leakage should occur in the conduit, thus enabling the slide joint to function satisfactorily with only one conduit intact.

6. The slide joint according to claim 1, further comprising an upper packer which seals against the outer pipe and a packer between the protective sleeve and the inner pipe which are adapted to permit fluid to pass from the second annulus between the protective sleeve and the outer pipe.

7. The slide joint according to claim 6, further comprising:

a double set of hydraulic conduits in hydraulic communication with the upper side of the first piston; and a shutoff valve at each end of each of the hydraulic conduits which serves to close off the hydraulic communication if a leakage should occur in the conduit, thus enabling the slide joint to function satisfactorily with only one conduit intact.

8. The slide joint according to claim 1, further comprising:

a double set of hydraulic conduits in hydraulic communication with an upper side of the first piston; and a shutoff valve at each end of each of the hydraulic conduits which serves to close off the hydraulic communication if a leakage should occur in the conduit, thus enabling the slide joint to function satisfactorily with only one conduit intact.

* * * * *